US006669606B2

(12) United States Patent
Krull

(10) Patent No.: US 6,669,606 B2
(45) **Date of Patent: *Dec. 30, 2003**

(54) WEIGHT SELECTION METHODS AND APPARATUS

(76) Inventor: Mark A. Krull, P.O. Box 57, Greencastle, IN (US) 46135

( * ) Notice: Subject to any disclaimer, the term of this patent is extended or adjusted under 35 U.S.C. 154(b) by 167 days.

This patent is subject to a terminal disclaimer.

(21) Appl. No.: 09/745,822

(22) Filed: Dec. 21, 2000

(65) Prior Publication Data

US 2001/0003723 A1 Jun. 14, 2001

Related U.S. Application Data

(63) Continuation-in-part of application No. 09/300,546, filed on Apr. 27, 1999.

(60) Provisional application No. 60/171,813, filed on Dec. 21, 1999, provisional application No. 60/119,014, filed on Feb. 8, 1999, and provisional application No. 60/108,768, filed on Nov. 17, 2000.

(51) Int. Cl.[7] ..... A63B 21/062; A63B 21/075

(52) U.S. Cl. ..... 482/98; 482/99; 482/107; 482/108

(58) Field of Search ..... 482/93, 94, 98, 482/106–108

(56) References Cited

U.S. PATENT DOCUMENTS

| | | | | |
|---|---|---|---|---|
| 3,647,209 A | * | 3/1972 | La Lanne | 482/103 |
| 5,839,997 A | * | 11/1998 | Roth et al. | 482/107 |
| 6,261,022 B1 | * | 7/2001 | Dalebout et al. | 482/107 |
| 6,402,666 B2 | * | 6/2002 | Krull | 482/107 |
| 6,422,979 B1 | * | 7/2002 | Krull | 482/98 |

FOREIGN PATENT DOCUMENTS

| | | | | |
|---|---|---|---|---|
| SU | 1258447 A | * | 9/1986 | A63B/23/04 |

* cited by examiner

*Primary Examiner*—Nicholas D. Lucchesi
*Assistant Examiner*—Fenn Mathew

(57) ABSTRACT

Weight supporting members are rotated into engagement with respective weight plates to provide adjustable resistance to exercise movement. On a first embodiment, the weight supports are rigidly mounted on a selector rod and rotate together therewith. On a second embodiment, the weight supports are rotatably mounted on the selector rod and rotate relative thereto.

18 Claims, 10 Drawing Sheets

WEIGHT SELECTION METHODS AND APPARATUS

CROSS-REFERENCE TO RELATED APPLICATIONS

This application is a continuation-in-part of U.S. patent application Ser. No. 09/300,546, filed on Apr. 27, 1999, which discloses subject matter entitled to the filing dates of U.S. Provisional Application Nos. 60/108,768 and 60/119,014, filed on Nov. 17, 1998, and Feb. 8, 1999, respectively, and this application also discloses subject matter entitled to the filing date of U.S. Provisional Application No. 60/171,813, filed on Dec. 21, 1999.

FIELD OF THE INVENTION

The present invention relates to exercise equipment and more particularly, to weight selection methods and apparatus.

BACKGROUND OF THE INVENTION

Various weight selection methods and apparatus have been developed to provide adjustable resistance to exercise. In the case of free weights, for example, weight plates are typically mounted on opposite ends of a bar. In relatively advanced systems, the bar is stored in proximity to the weight plates, and a selection mechanism is provided to connect a desired amount of weight to the bar. Some examples of patented barbell/dumbbell improvements and/or features are disclosed in U.S. Pat. No. 4,284,463 to Shields (discloses a dumbbell assembly having opposite side weights which are maintained in alignment on a base and selectively connected to a handle by means of cam driven pins on the weights); U.S. Pat. No. 4,529,198 to Hettick, Jr. (discloses a barbell assembly having opposite side weights which are maintained in alignment on respective storage members and selectively connected to a handle by means of axially movable springs); U.S. Pat. No. 4,822,034 to Shields (discloses both barbell and dumbbell assemblies having opposite side weights which are maintained in alignment on a shelf and selectively connected to a handle by means of latches on the weights); U.S. Pat. No. 5,769,762 to Towley, III et al. (discloses a dumbbell assembly having a plurality of interconnected opposite side weights which are stored in nested relationship to one another and selectively connected to a handle by various means); and U.S. Pat. No. 5,839,997 to Roth et al. (discloses a dumbbell assembly having opposite side weights which are maintained in alignment on a base and selectively connected to a handle by means of eccentric cams on a rotating selector rod. Despite these advances and others in the field of weight selection, room for improvement remains.

SUMMARY OF THE INVENTION

One aspect of the present invention is to provide weight selecting members that are rotatable into engagement with respective weight plates to provide adjustable resistance to exercise movement. In a preferred application, the weight selecting members are mounted on a rod that extends horizontally and is movable radially into and out of a horizontal array of weights. On one embodiment, the weight selecting members are rigidly secured to the rod and rotate together therewith. On another embodiment, the weight selecting members are rotatably mounted on the rod and rotate relative thereto. Additional features and/or advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF THE PREFERRED EMBODIMENT

The present invention provides methods and apparatus for selectively adjusting weight resistance to exercise motion.

Generally speaking, one or more weight selecting members are rotated into and out of engagement with weight plates in order to select a desired number and/or combination of the weight plates.

Figure 1:
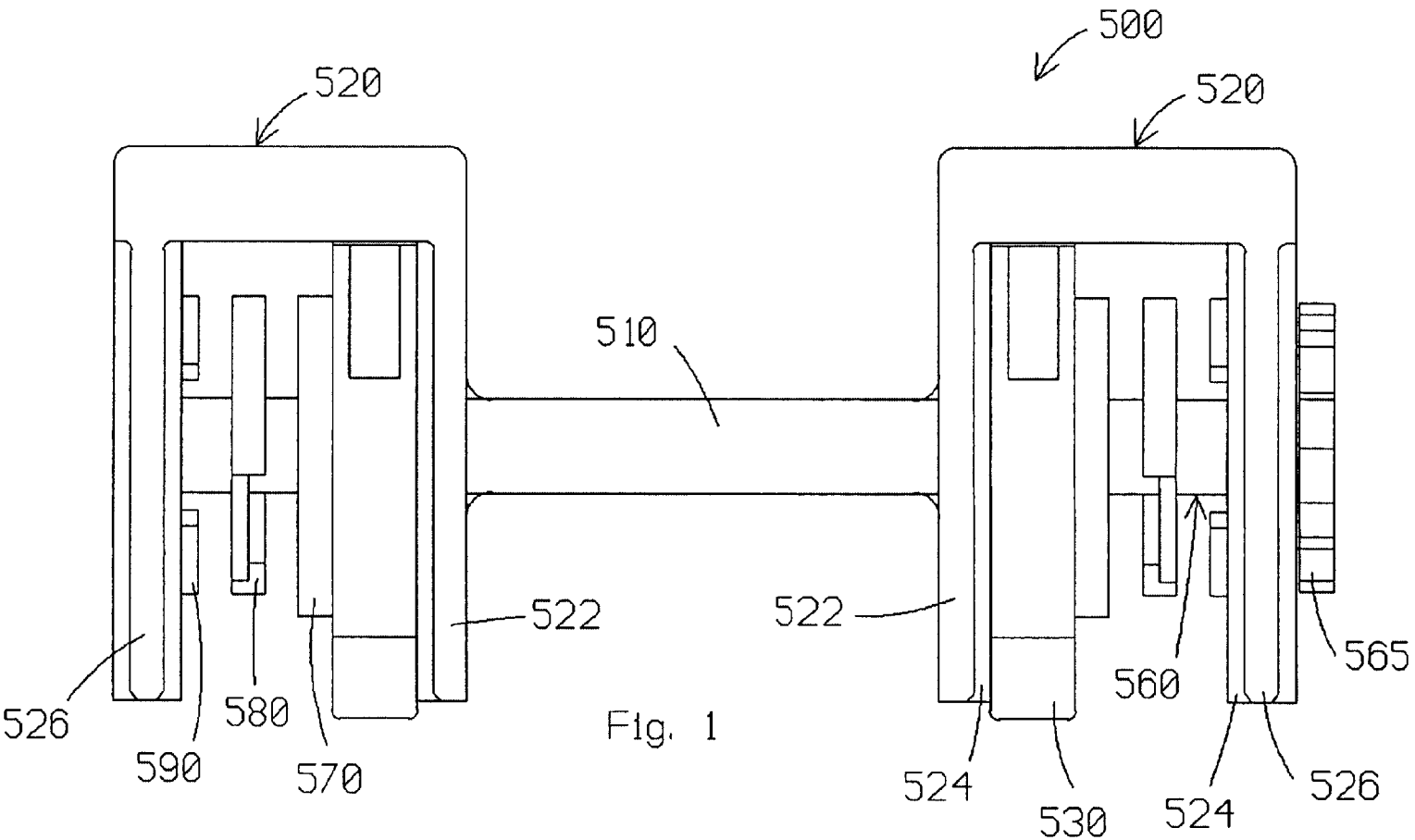
FIG. 1 is a side view of an exercise dumbbell constructed according to the principles of the present invention.
Figure 17:
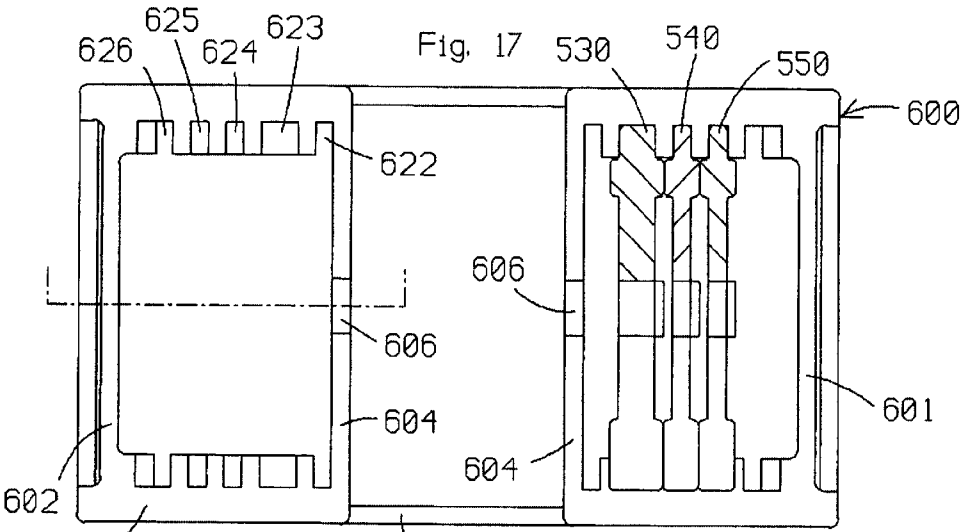
FIG. 17 is a partially sectioned top view of the weights of FIG. 13 resting on a cradle constructed according to the principles of the present invention.
Figure 18:
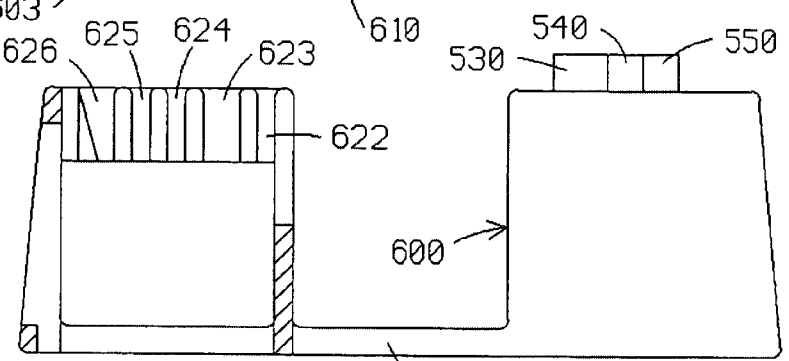
FIG. 18 is a partially sectioned side view of the weights and cradle of FIG. 17.
Figure 19:
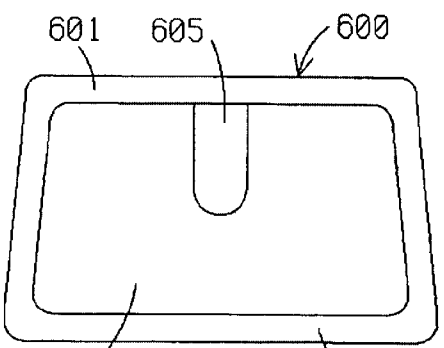
FIG. 19 is an end view of the cradle of FIG. 17 without the weights.
Figure 20:
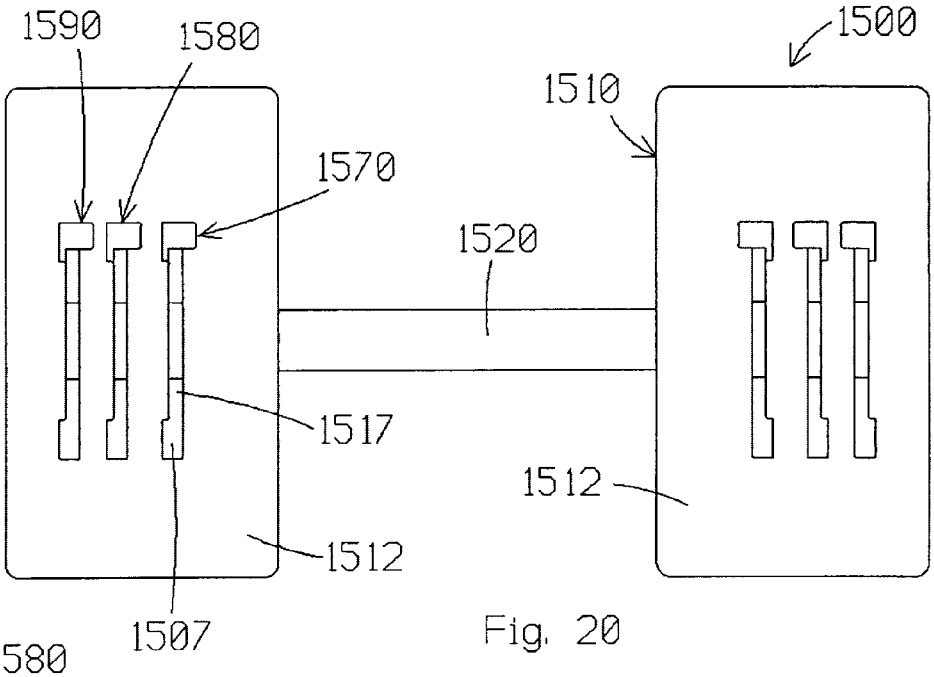
FIG. 20 is a top view of another dumbbell constructed according to the principles of the present invention.
Figure 21:
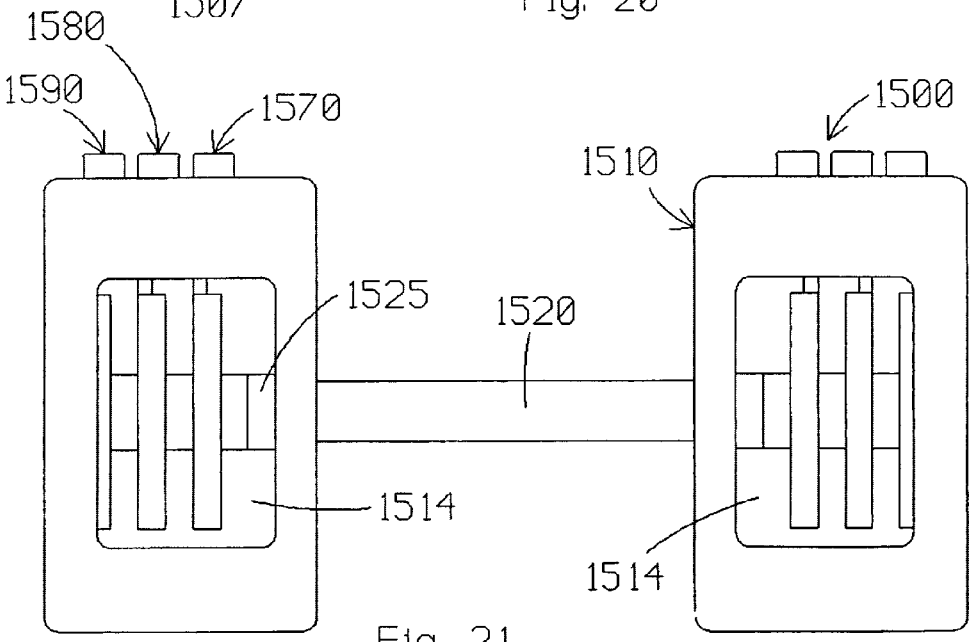
FIG. 21 is a side view of the dumbbell of FIG. 20.

A first embodiment of the present invention is an exercise dumbbell designated as 500 in FIG. 1. The dumbbell 500 has an intermediate handle 510 that is sized and configured for grasping, and opposite end, weight housings 520 that are sized and configured to accommodate respective weight plates 530, 540, and 550. When not in use, the supports 520 and the weight plates 530, 540, and 550 rest on a base or cradle designated as 600 in FIGS. 17–19. Other suitable weight supporting arrangements are disclosed in U.S. Pat. No. 4,284,463 to Shields; U.S. Pat. No. 4,529,198 to Hettick, Jr.; U.S. Pat. No. 4,822,034 to Shields; U.S. Pat. No. 5,769,762 to Towley, III et al.; U.S. Pat. No. 5,839,997 to Roth et al.; U.S. Pat. No. 6,033,350 to Krull; and/or U.S. Pat. No. 6,099,442 to Krull, all of which are incorporated herein by reference.

Figure 2:
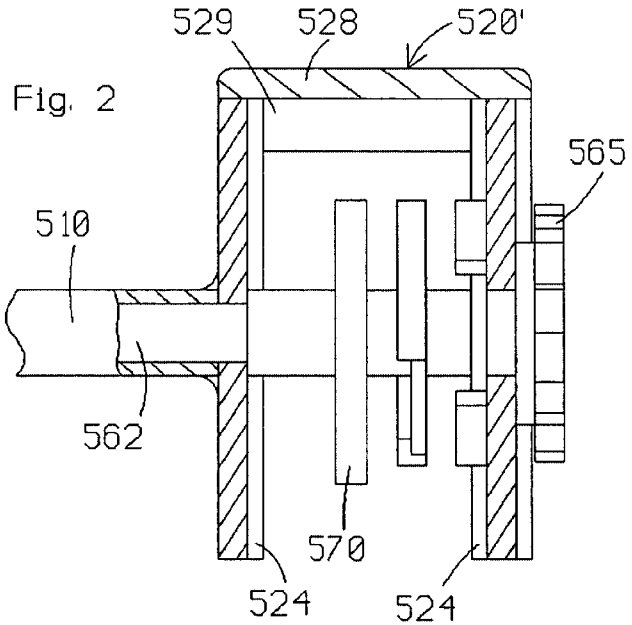
FIG. 2 is partially sectioned side view of one end of the dumbbell of FIG. 1.

The handle 510 is a cylindrical tube having a longitudinal axis and opposite ends secured to respective housings 520 by welding or other suitable means. Each of the housings 520 includes an inside end wall 522, an outside end wall 526, a top wall 528, and opposite side walls 529, which cooperate to define a downwardly opening compartment. FIG. 1 shows integrally molded housings 520, and FIG. 2 shows an alternative housing 520' that is identical in size and configuration, but assembled from three discrete parts. In either case, spacers may extend downward from the top wall 528 to occupy axial spaces between the weight plates 530, 540, and 550. Axially offset shoulders 524 are provided on interior, diametrically opposed sides of each end wall 522 and 526 to engage respective weights 530 and 550 and provide centrally located gaps therebetween. The shoulders 524 are disposed inward from the outside edges of the walls 522 and 526.

A selector rod 560 is rotatably mounted relative to both the handle 510 and the housings 520. The selector rod 560 includes a shaft 561 and two sets of three weight engaging members or supports 570, 580, and 590 mounted on opposite ends of the shaft 561. The shaft 561 includes an intermediate portion 562 having a circular profile, and opposite end portions 563 having clipped circular profiles (a flat surface is cut into an otherwise circular profile). The intermediate portion 562 extends through the handle 510 and through the inside end wall 522 of each housing 520. Each end portion 563 extends through a respective housing 520 and through a respective outside end wall 526.

Figure 7:
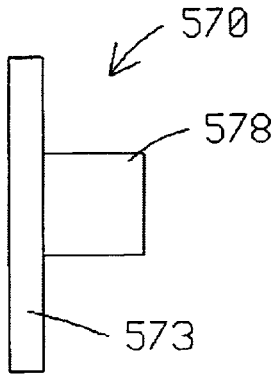
FIG. 7 is a side view of a first weight engaging member on the dumbbell of FIG. 1.
Figure 8:
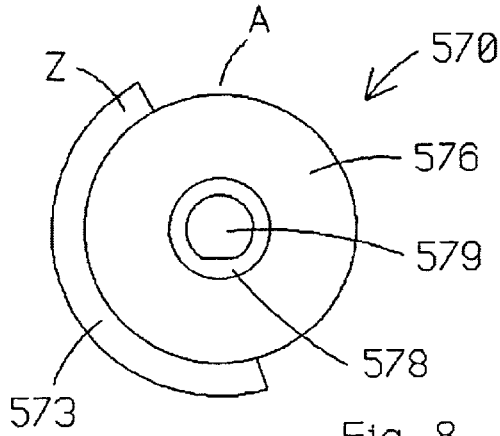
FIG. 8 is an end view of the weight engaging member of FIG. 7.

The innermost weight support 570 is shown by itself in FIGS. 7–8. The support 570 includes an axially extending hub 578, a radially extending rim 576, and an axially extending lip 573. The support 570 is a single piece of integrally molded plastic, and the rim 576 may be said to be integrally connected between the lip 573 and the hub 578. An opening 579, sized and configured to receive an end 563 of the shaft 561, extends through the hub 578 and the rim 576. The lip 573 includes a single, continuous segment which extends through an arc of 167.5° The single segment spans several sectors, including sector Z, but it does not span any portion of sector A.

Figure 9:
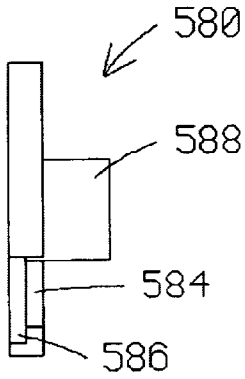
FIG. 9 is a side view of a second weight engaging member on the dumbbell of FIG. 1.
Figure 10:
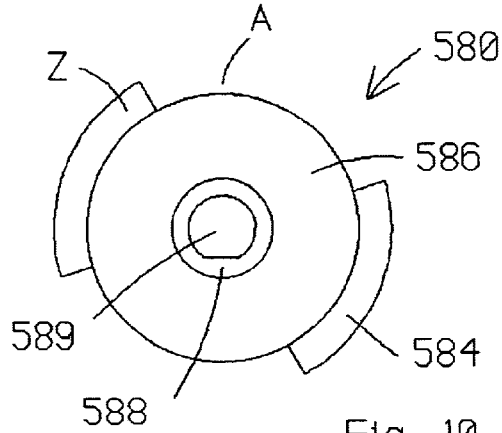
FIG. 10 is an end view of the weight engaging member of FIG. 9.

The intermediate weight support 580 is shown by itself in FIGS. 9–10. The support 580 includes an axially extending hub 588, a radially extending rim 586, and an axially extending lip 584. The support 580 is a single piece of integrally molded plastic, and the rim 586 may be said to be integrally connected between the lip 583 and the hub 588. An opening 589, sized and configured to receive an end 563 of the shaft 561, extends through the hub 588 and the rim 586. The lip 583 includes two diametrically opposed segments which extend through respective arcs of 77.5° One of the segments spans the sector Z, as well as another adjacent sector, but neither of the segments spans any portion of the sector A.

Figure 11:
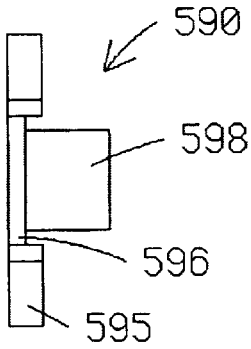
FIG. 11 is a side view of a third weight engaging member on the dumbbell of FIG. 1.
Figure 12:
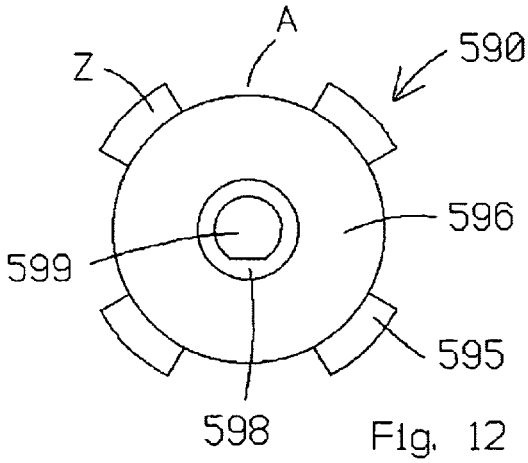
FIG. 12 is an end view of the weight engaging member of FIG. 11.
Figure 13:
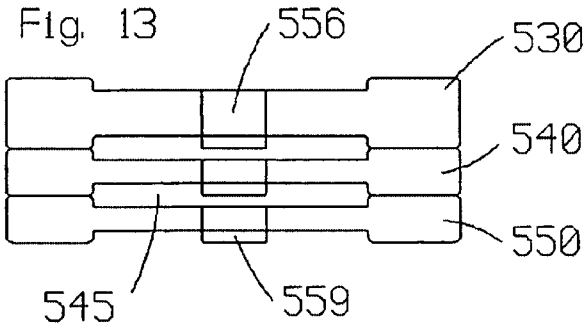
FIG. 13 is a top view of three adjacent weights on the dumbbell of FIG. 1.

The outermost weight support 590 is shown by itself in FIGS. 11–12. The support 590 includes an axially extending hub 598, a radially extending rim 596, and an axially extending lip 594. The support 590 is a single piece of integrally molded plastic, and the rim 596 may be said to be integrally connected between the lip 593 and the hub 598. An opening 599, sized and configured to receive an end 563 of the shaft 561, extends through the hub 598 and the rim 596. The lip 593 includes four circumferentially spaced segments which extend through respective arcs of 32.5° One of the segments spans the sector Z, but none of the segments spans any portion of the sector A.

Figure 3:
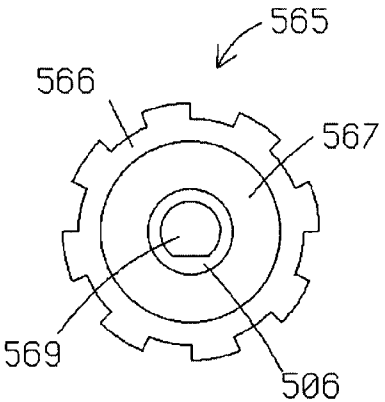
FIG. 3 is an end view of a knob on the dumbbell of FIG. 1.
Figure 4:
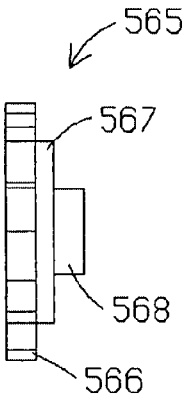
FIG. 4 is an opposite side view of the knob of FIG. 3.
Figure 5:
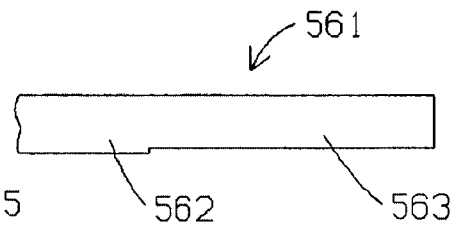
FIG. 5 is a side view of one end of a shaft on the dumbbell of FIG. 1.
Figure 6:
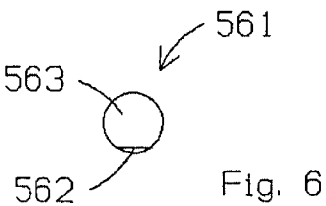
FIG. 6 is an end view of the shaft of FIG. 5.

A fastener is fastened to one end 563 of the shaft 561, just beyond the outside end wall 526, and a knob 565 is fastened to an opposite end 563 of the shaft 561 just beyond the opposite, outside end wall 526. As shown in FIGS. 3–4, the knob 565 includes a relatively large diameter rim 566 which is sized and configured for grasping, an intermediate portion 567 which bears against the outside end wall 526, and a relatively small diameter hub 568 which extends through the outside end wall 526. A recess 506 is provided in the hub 568 to receive a discrete fastener in countersunk fashion. Both the knob 565 and the supports 570, 580, and 590 rotate together with the shaft 560 relative to the housings 520 and the handle 510.

Figure 14:
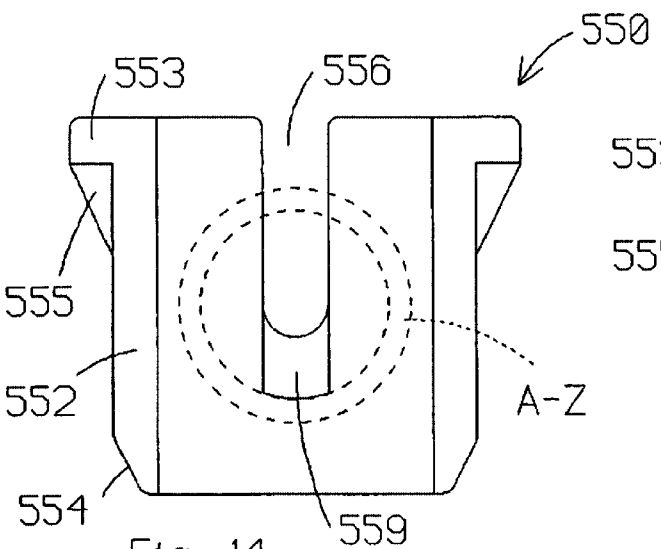
FIG. 14 is an end view of one of the weights shown in FIG. 13.
Figure 15:
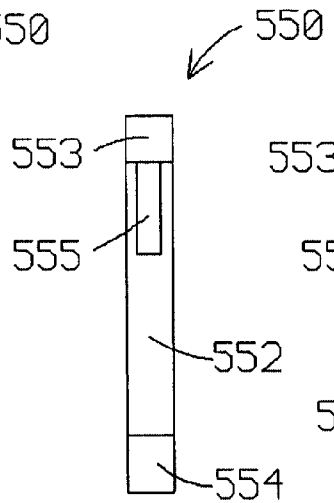
FIG. 15 is a side view of the weight of FIG. 14.
Figure 16:
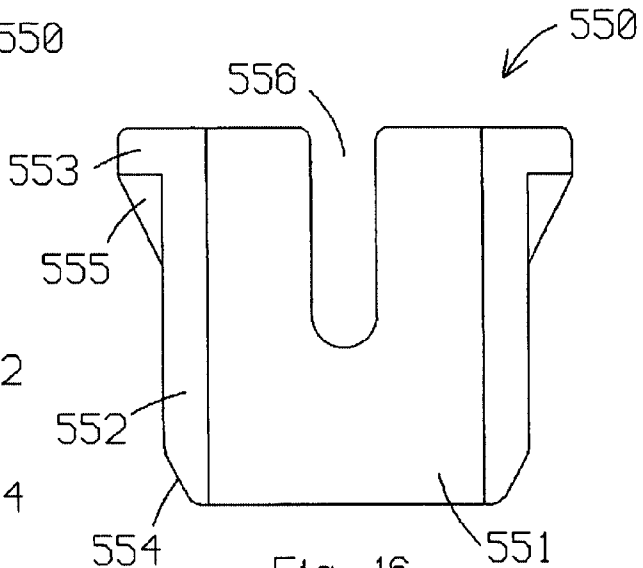
FIG. 16 is an opposite end view of the weight of FIG. 14.

The weight plates 530, 540, and 550 are shown in greater detail in FIGS. 13–16. The two plates 540 and 550 are shown with the same thickness, but the plate 550 is one-half as dense and thus, weighs one-half as much as the plate 540, which in turn, weighs one-half as much as the plate 530. The front and back views of the plate 550 shown in FIGS. 14 and 16 are representative of similar views of the other plates 540 and 530.

Each side of the plate 550 (and the plates 540 and 530) may be described with reference to a relatively thinner, intermediate portion 551 and relatively thicker, opposite side portions 552. The side portions 552 bear against adjacent counterparts and/or against shoulders 524 on respective end walls 522 or 526, and the intermediate portion 551 cooperates with adjacent counterparts and/or the end walls 522 or 526 to define gaps 545 disposed between the side portions 552 and the shoulders 524. The gaps 545 are sized and configured to receive respective weight supports 570, 580, and 590. FIG. 14 shows how the plates 550, 540, and 530 axially align with the supports 590, 580, and 570 (the rim sectors A–Z are shown in dashed lines).

An elongate slot 556, sized and configured to accommodate the axial hub 598, 588, or 578 of a respective support 590, 580, or 570 extends downward into each of the plates 550, 540, and 530. Immediately beneath the slot 556, a peg 559 projects axially outward from the intermediate portion 551 of the plate 550 (and each of the plates 540 and 530). The peg 559 is disposed just inside the space (sectors A–Z) occupied by the axially extending lip 595 on the support 590. When a segment of the lip 595 is disposed beneath the peg 559, the plate 550 is constrained to move upward together with the handle 510.

The upper ends of the side portions 552 terminate in respective laterally extending portions 553 that extend away from one another. The lateral portions 553 are the same thickness as the side portions 552. The lower ends 554 of the side portions 552 are beveled or tapered. Relatively thinner, triangular fins 555 extend between respective lateral portions 553 and respective side portions 552. The fins 555 are sized and configured to fit within opposing slots 625 in the base 600, and the lateral portions 553 are designed to rest on top of the ledge 603. Similar fins 555 on the plates 540 and 530 are sized and configured to fit within other, respective slots 624 and 623 in the base 600. The grooves 623–625 are bounded by inclined, opposing walls which cooperate to center the plates 530, 540, and 550 relative to the base 600. Additional grooves 622 and 626 are provided in the base 600 to receive the end walls 522 and 526, respectively. The grooves 626 are bounded by relatively outward walls which are inclined upward and away from the middle of the base 600. Those skilled in the art will recognize that alignment of the weight plates may be achieved in various ways without departing from the scope of the present invention.

The base 600 includes a bottom 610 sized and configured to rest upon a flat surface, such as a table top or floor. Opposite end portions 601 and 602 extend upward from the bottom 610. In addition to outside walls, interior walls 604 extend upward from the bottom 610 and between opposing end walls 522 on respective housings 520. Elongate slots 606 extend downward into the interior walls 604 to accommodate the handle 510. When the plates 530, 540, and 550 are suspended from the base 600, the slots 606 align with the slots 556.

The supports 570, 580, and 590 are designed for rotation in 45° increments. A ball detent or other known biasing system may be interconnected between the housing 520 and either the knob 565 or the shaft selector rod 560, for example, to bias the selector rod 560 toward the desired orientations. The lips 573, 584, and 595 are configured to provide clearance or tolerance vis-a-vis the pegs 559. In particular, when any given plate 530, 540, or 550 is not engaged, the respective lip 573, 584, or 595 is at least 6.5° outside the boundary of the peg 559. With reference to the support 590, for example, each of the lip segments 595 spans an arc of 32.5°.

The weight selecting members 570, 580, and 590 may also be configured to minimize wobbling or rattling of the selected weight plates. For example, leaf springs may be incorporated into the members 570, 580, and 590 during the molding process, for purposes of exerting pressure against any selected weights. Moreover, the weights may also be configured to be relatively thicker just beneath the peg 559, so that the leaf springs are relatively more compressed when disposed beneath the peg 559.

The configurations of the plates 530, 540, and 550 and the weight supports 570, 580, and 590 are such that any combination of the plates 530, 540, and 550 may be secured to the handle 510 form removal from the base 600. In this regard, when the supports 570, 580, and 590 occupy the respective orientations shown in FIGS. 8, 10, and 12, the plate 530 is engaged to the exclusion of the plates 540 and 550. When the supports 570, 580, and 590 are rotated 180°, the sector designated as A underlies the pegs 559 on the plates 530, 540, and 550, and none is secured to the handle 510. When the supports 570, 580, and 590 are rotated until the sector designated as Z underlies the pegs 559, all of the plates 530, 540, and 550 are engaged.

Assuming that the handle 510 and the housings 520 collectively weigh ten pounds, and the plates 530, 540, and 550 weigh ten pounds, five pounds, and two and one-half pounds, respectively, the following chart shows how different amounts of weight may be selected as a function of the orientation of the selector rod 560.

| Rod | Handle | Weights 590 | Weights 580 | Weights 570 | Total |
|---|---|---|---|---|---|
| — | 10 | 0 | 0 | 0 | 10 |
| 45° | 10 | 5 | 0 | 0 | 5 |
| 90° | 10 | 0 | 10 | 0 | 20 |
| 135° | 10 | 5 | 10 | 0 | 25 |
| 180° | 10 | 0 | 0 | 20 | 30 |
| 225° | 10 | 5 | 0 | 10 | 35 |
| 270° | 10 | 0 | 10 | 20 | 40 |
| 35° | 10 | 5 | 10 | 20 | 45 |
| 360° | 10 | 0 | 0 | 0 | 10 |

An advantage of this embodiment 500 is that only three discrete weights are required on each side of the dumbbell to provide eight different, balanced dumbbell loads. Moreover, the number of available dumbbell loads may be doubled by adding two "half-weights" which weigh one-half as much as one of the plates 590. For example, half-weights could be connected to the inside end walls 522 of the base 510 by means of hook and loop fasteners.

Another advantage of the dumbbell 500 is that it can be manufactured relatively efficiently, especially as compared to the dumbbell disclosed in U.S. Pat. No. 5,839,997 to Roth et al. For example, the relatively gross, "over/under" relationship between the weight supports 570, 580, and 590 and the weight plates 530, 540, and 550 requires a less stringent manufacturing process. The weight supports 570, 580, and 590 are relatively simple parts which may be injection molded, and the weights 530, 540, and 550 are relatively simple parts which may be cast.

FIGS. 20–29 show another dumbbell constructed according to the principles of the present invention. The dumbbell 1500 has weight selectors 1570, 1580, and 1590 which rotate relative to a handle 1520 and independent of one another to provide eight different, balanced weight combinations (and sixteen combinations if balance is not a critical concern).

First and second weight supporting boxes 1512 are rigidly secured to respective end portions of the handle 1520 to collectively define a base 1510. The weight selectors 1570, 1580, and 1590 are disposed inside the boxes 1512 and are rotatably mounted on respective end portions of the handle 1520. To the extent that economies of scale may warrant making all of the weight selectors identical, spacers 1525 are also mounted on the handle 1520 to accommodate the additional thickness of the largest weight plates 1550. The boxes 1512 define weight receiving compartments 1514, and the weight selectors 1570, 1580, and 1590 divide the compartments 1514 into individual weight receiving slots.

Figure 22:
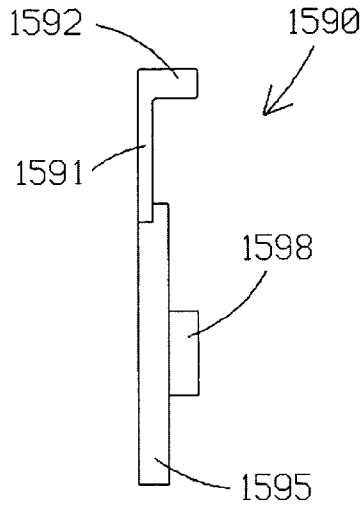
FIG. 22 is a side view of a weight selector on the dumbbell of FIGS. 20–21.
Figure 23:
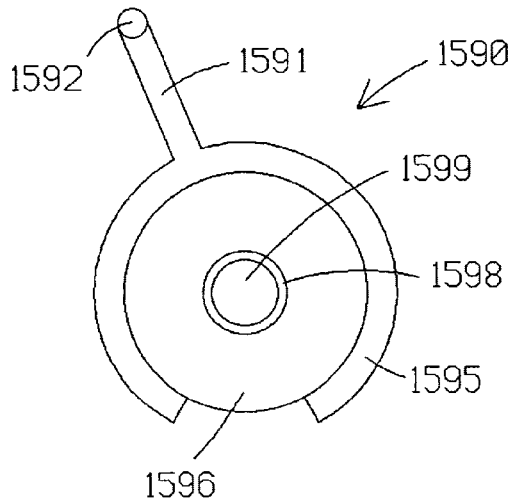
FIG. 23 is an end view of the weight selector of FIG. 22.
Figure 24:
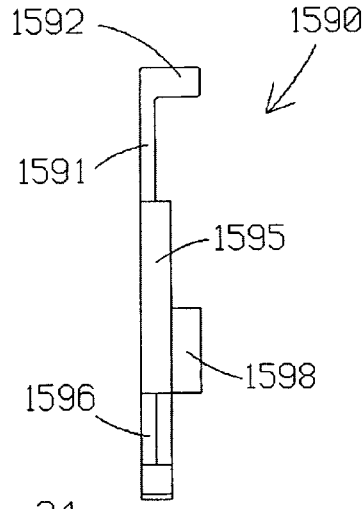
FIG. 24 is a side view of the weight selector of FIG. 22 rotated to a weight engaging orientation.
Figure 25:
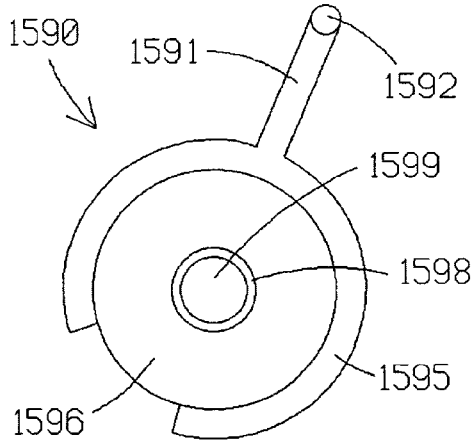
FIG. 25 is an end view of the weight selector of FIG. 24.
Figure 26:
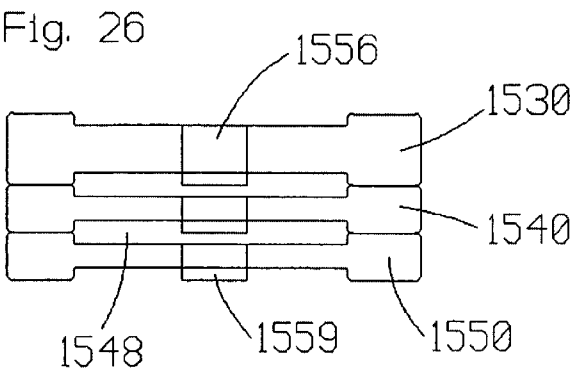
FIG. 26 is a top view of weights plates suitable for use with the dumbbell of FIGS. 20–21.
Figure 27:
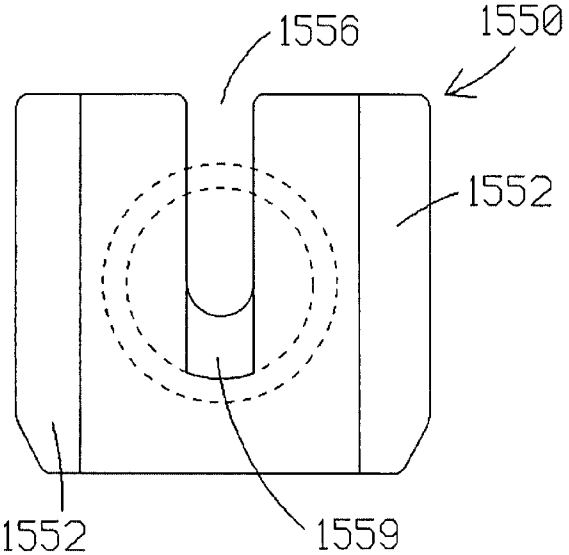
FIG. 27 is an end view of one of the weight plates of FIG. 26.
Figure 28:
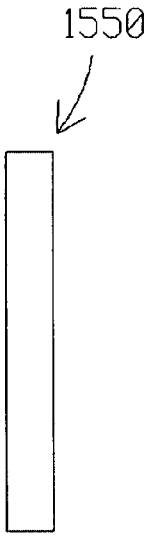
FIG. 28 is a side view of the weight plate of FIG. 27.
Figure 29:
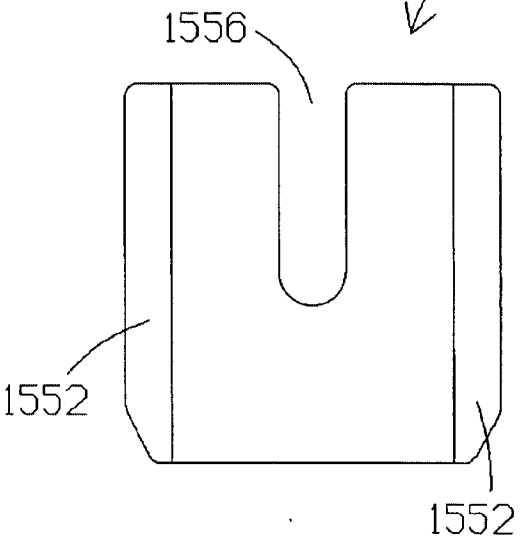
FIG. 29 is an opposite end view of the weight plate of FIG. 27.

FIGS. 22–23 show the weight selector 1590 in a disengaged orientation, and FIGS. 24–25 show the weight selector 1590 in a weight engaging orientation. The weight selector 1590 includes a cylindrical hub 1598 with a circular hole 1599 extending through same. A circular plate 1596 extends radially away from the hub 1598, and a cylindrical rim 1595 extends circumferentially about the majority of the plate 1596. The gap in the rim 1595 is disposed vertically beneath the hub 1598 when the weight selector 1590 occupies the disengaged orientation shown in FIGS. 22–23. An arm 1591 extends radially away from the rim 1595 and terminates in an axially extending handle 1592.

FIGS. 26–29 show weight plates 1530, 1540, and 1550 suitable for use with the dumbbell 1500. Each plate 1530 weighs ten pounds; each plate 1540 weighs five pounds; and each plate 1550 weighs two and one-half pounds. The plates may be described as generally square plates having chamfered lower corners and relatively thick side walls 1552. The walls 1552 on adjacent plates cooperate to define central gaps (1548, for example) between the plates to accommodate respective, intervening weight selectors. An elongate slot 1556 extends downward from an upper edge of each plate to accommodate the hub 1598 of a respective weight selector. A boss 1559 projects outward from the plate immediately beneath the lower end of the slot 1556 for selectively engagement by the rim 1595 on a respective weight selector (see dashed lines). As suggested by other embodiments discussed above, the weight plates are stored on a suitable cradle when not in use.

The arm 1591 on each of the weight selectors 1570, 1580, and 1590 extends through a respective slot (1517, for example) in the base 1510, thereby making each handle 1592 accessible to a user. The ends (1507, for example) of the slots are notched to discourage undesired rotation of the handles 1592. In particular, the handles 1592 must be forced toward the center of the dumbbell 1500 prior to pivoting relative to the handle 1520. The resilient nature of the arms 1591 accommodate this level of deflection, in a manner similar to a leaf spring.

Figure 30:
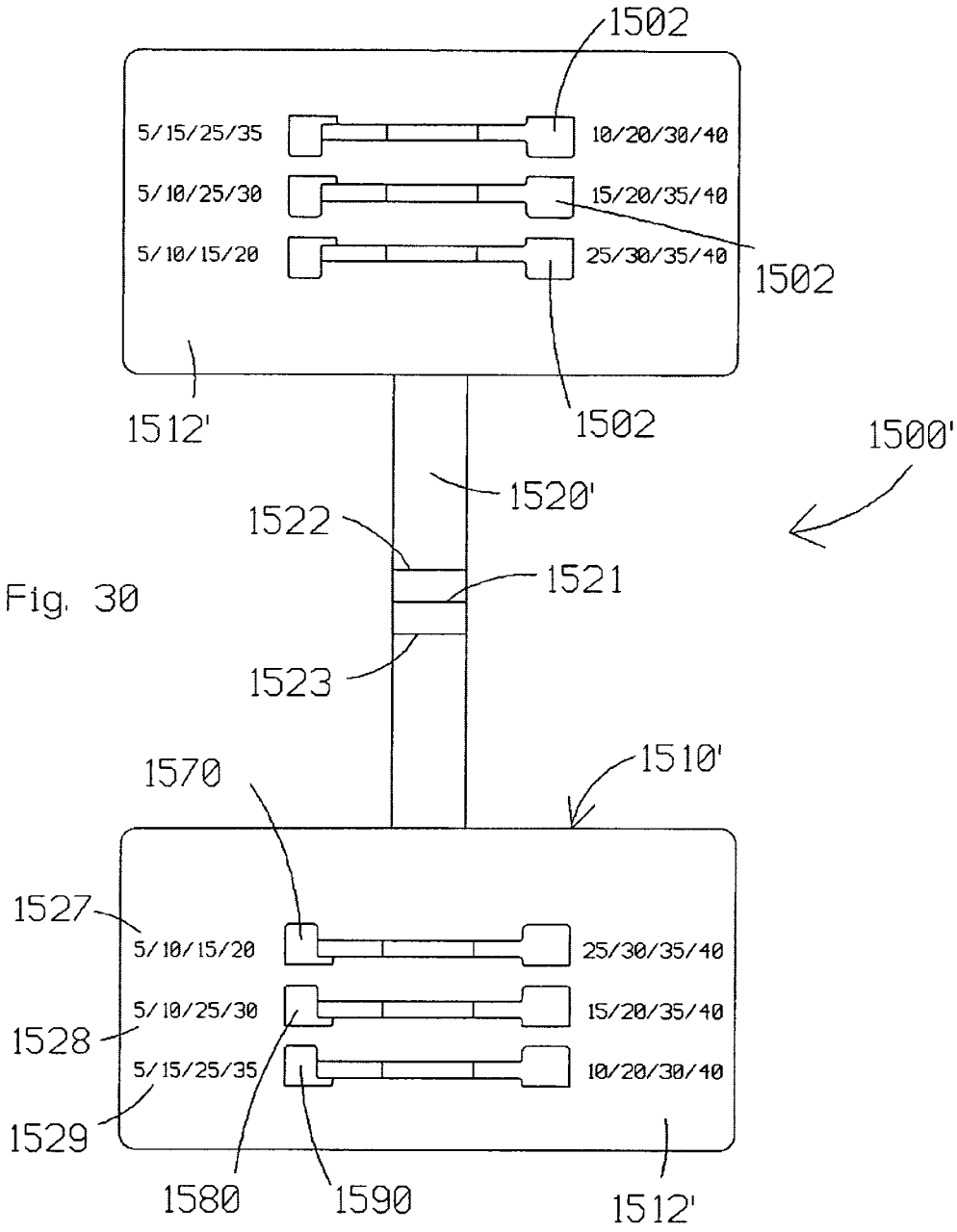
FIG. 30 is a top view of a dumbbell similar to the dumbbell of FIGS. 20–21, with optional features added.

As suggested by the common reference numerals, FIG. 30 shows a dumbbell 1500' similar to the dumbbell 1500, but with three additional features. First, indicia 1527, 1528, and 1529 on the tops of the boxes 1512' show the appropriate positions for the handles of respective weight selectors 1570, 1580, and 1590 for any desired amount of weight to be selected. For example, if twenty-five pounds is desired, then the handle 1592 on the weight selector 1590 is rotated toward the right side of FIG. 30, and the handles 1592 on the weight selectors 1580 and 1590 are rotated toward the left side of FIG. 30. Second, indicia 1521, 1522, and 1523 are provided on the handle 1520' to show appropriate center positions for the amount of weight that is selected. For example, if equal weight is selected on each end of the handle 1520', then a person should center his hand relative to the line 1521. On the other hand, if twenty-seven and one-half pounds is selected by rotating only the handle 1592 on the lower weight selector 1590 toward the right side of FIG. 30, then a person should center his hand relative to the line 1523. One or both forms of similar indicia may be provided on other embodiments discussed herein, as appropriate.

The tops of the boxes 1512' on the dumbbell 1500' are provided with relatively larger openings 1502 at the ends of the slots nearer the right side of FIG. 30. The openings 1502 are sized and configured to admit passage of the handles 1592 during assembly of the dumbbell 1500'. Similar openings 1502 may be provided on the dumbbell 1500, or the weight selectors 1570, 1580, and 1590 may be assembled from more than one piece to facilitate insertion of the arms 1591 through the slots, or the handles 1592 may be made no larger than the openings 1507 shown in FIG. 20.

Figure 31:
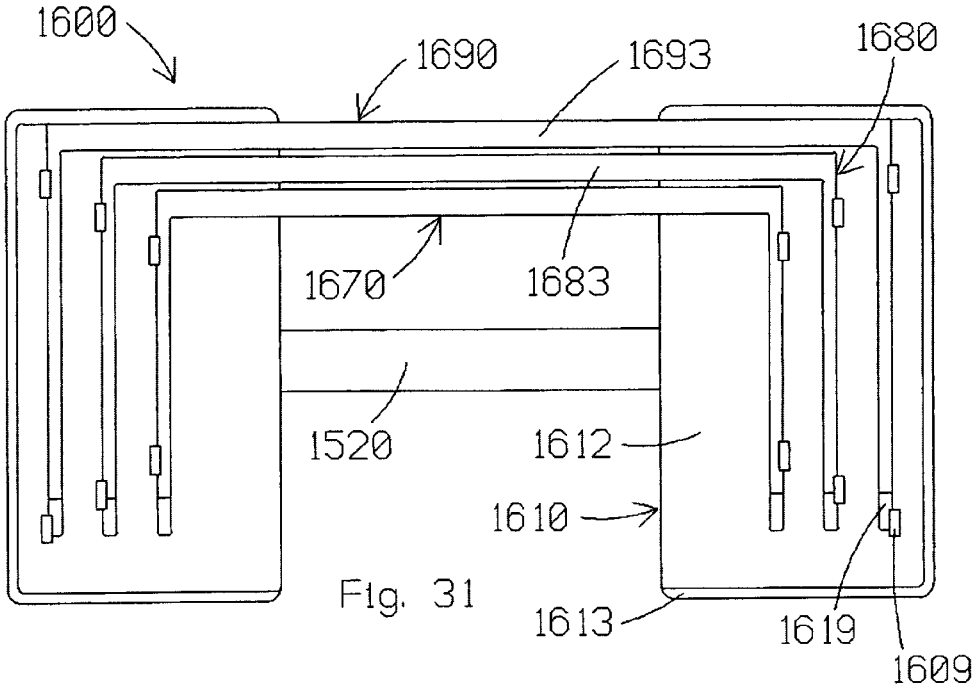
FIG. 31 is a top view of a dumbbell similar to the dumbbell of FIGS. 20–21, with respective opposite side weight selectors connected to one another.
Figure 32:
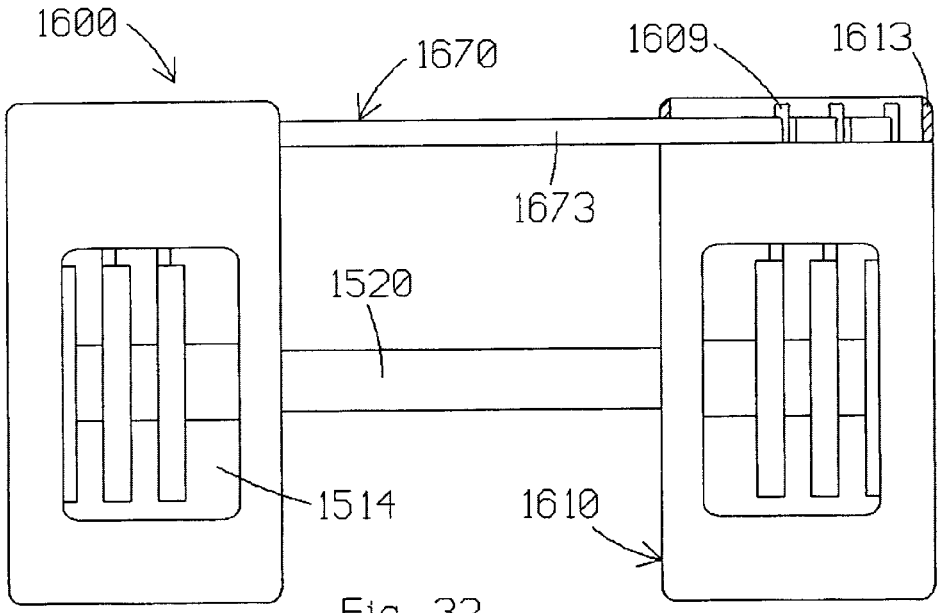
FIG. 32 is a side view of the dumbbell of FIG. 31

FIGS. 31–32 show a dumbbell 1600 similar to the dumbbell 1500, but with interconnected pairs of weight selectors designated as 1670, 1680, and 1690, and a base 1610 that has been modified to accommodate same. The base 1610 includes the same handle 1520 and similarly sized boxes 1612 rigidly secured to opposite ends of the handle 1520. As on the two previous embodiments, the boxes 1612 define weight receiving compartments 1514 which are separated into individual weight slots by weight selectors rotatably mounted on the handle 1520. The top of each box 1612 is provided with an upwardly extending rim 1613 that extends along the outside end and the opposing sides to shelter the weight selectors and structure for latching same in place.

The weight selector 1670 may be described in terms of opposite side weight selectors 1570 having their handles 1592 interconnected by an integral extension 1673. The weight selector 1680 may be described in terms of opposite side weight selectors 1580 having relatively longer arms and their handles 1592 interconnected by a relatively longer integral extension 1683. The weight selector 1690 may be described in terms of opposite side weight selectors 1590 having even longer arms and their handles 1592 interconnected by an even longer integral extension 1693. Relatively longer slots (1619, for example) are provided in the tops of the boxes 1612 to accommodate pivoting of the longer arms. For assembly purposes, the arms may be inserted through respective slots and then interconnected by respective extensions 1673, 1683, and 1693. Inverted L-shaped tabs 1609 are provided on the boxes 1612 proximate the ends of the slots to latch respective weight selector pairs 1670, 1680, and 1690 in place. The tabs 1609 and/or the arms resiliently deflect to accommodate the latching and unlatching process. An advantage of this embodiment 1600 is that the opposite side weight plates are latched and unlatched simultaneously.

The present invention may also be described in various ways. For example, the present invention may be described as an adjustable exercise weight system, comprising: a base which includes a handle and weight supports at opposite ends of the handle; weights sized and configured for engagement by the weight supports; and weight selectors rotatably mounted on the handle and disposed adjacent respective weights, wherein each of the weight selectors is independently rotatable between a weight engaging orientation and a free orientation relative to a respective one of the weights. The weights may be provided in opposite side pairs, and/or the opposite side weight selectors associated with each of the pairs may be interconnected to move as a unit. In addition and/or the alternative, indicia may be provided to show how the weight selectors should be maneuvered to select a desired amount of weight, and/or to indicate where the handle should be grasped in order to offset an imbalance in the amount of selected weight at each end of the handle.

The present invention may also be described in terms of various methods of providing adjustable weight resistance. For example, one such method involves the provision of a plurality of aligned weights; the provision of a discrete weight support for each of the weights; and the rotation of the supports relative to the weights until a respective weight support underlies each desired weight. This method may further involve mounting the weight supports on a rod, and providing slots in the weights to receive the rod; having the rod occupy all such slots during rotation, regardless of which weights are being selected; rotating the rod a fraction of a revolution to engage an additional weight; and/or exerting pressure against the selected weights. With regard to this last option, a weight stabilizing system may be implemented by providing protruding portion(s) on the weight plates and/or the weight selectors, and arranging the protruding portions to engage only when the weight selectors are rotated into engagement with respective weights. For example, a leaf spring on the weight selector may be arranged to occupy the slot in the weight when not engaged, and to rest between spaced apart bumps on the weight when the weight selector is moved to an engagement orientation.

The present invention may also be described as a method of adjusting exercise resistance, involving provision of a plurality of aligned weights; provision of a discrete weight support for each of the weights; and rotation of the weight supports into engagement with desired weights. The weight supports may be independently rotated or secured to a common selector rod. In the latter case, the selector rod may be rotated a first amount relative to the weights to engage a first weight; and rotated a second amount relative to the weights to engage a second weight. Such a method may further involve rotating the selector rod a first amount to engage only the first weight, a second amount to engage only the second weight, and a third amount to engage both the first weight and the second weight.

The foregoing description and accompanying figures are limited to only some of the many conceivable embodiments to be constructed in accordance with the principles of the present invention. Other embodiments, methods, and/or modifications will become apparent to those skilled in the art as a result of this disclosure. Moreover, those skilled in the art will also recognize that aspects and/or features of various methods and embodiments may be mixed and matched in numerous ways to arrive at still more variations of the present invention. In view of the foregoing, the scope of the present invention is to be limited only to the extent of the following claims.

What is claimed is:

1. A method of providing adjustable resistance to exercise, comprising the steps of:

providing a rod having a longitudinal axis;

providing weight supporting members on the rod at axially spaced positions along the rod;

providing a plurality of aligned weights with openings sized and configured to accommodate the rod, and gaps disposed between adjacent weights to accommodate respective members;

moving the rod downward into the openings in a manner which aligns each of the members with a respective one of the gaps;

rotating the members relative to the weights until respective members underlie desired ones of the weights;

separately latching each of the members in a desired orientation; and moving the rod upward together with the desired ones of the weights.

2. The method of claim 1, wherein each of the weight supporting members is independently rotated relative to the rod.

3. The method of claim 1, wherein the rod is provided with an intermediate portion that is sized and configured for grasping, and the weight supporting members are provided at opposite ends of the intermediate portion.

4. A method of providing adjustable resistance to exercise, comprising the steps of:

providing a rod having a longitudinal axis;

providing weight supporting members on the rod at axially spaced positions along the rod;

providing a plurality of aligned weights with openings sized and configured to accommodate the rod, and gaps disposed between adjacent weights to accommodate respective members;

moving the rod downward into the openings in a manner that aligns each of the members with a respective one of the gaps, wherein the rod is held in a horizontal orientation as the rod is moved downward into the openings;

rotating the members relative to the weights until respective members underlie desired ones of the weights; and moving the rod upward together with the desired ones of the weights, wherein the rod is held in a horizontal orientation as the rod is moved upward out of the openings.

5. The method of claim 4, wherein each of the weight supporting members is independently rotated relative to the rod.

6. The method of claim 4, wherein each of the weight supporting members is independently latched relative to the rod.

7. A method of providing adjustable resistance to exercise, comprising the steps of:

providing a first set of weights and a second set of weights;

providing a base sized and configured to support each set of weights at a respective end of the base;

providing a handle member having an intermediate portion that is sized and configured for grasping, a first end portion that is sized and configured to support the first set of weights, and an opposite, second end portion that is sized and configured to support the second set of weights;

providing a plurality of separately rotatable weight selectors on each said end portion, wherein each of the weight selectors is configured and arranged to selectively engage and disengage a respective one of the weights as a function of orientation relative thereto;

moving the handle member to a rest position relative to the weights and the base;

rotating a first subset of the weight selectors to a first orientation relative to the handle member to engage respective weights; and rotating a second subset of the weight selectors to a second orientation relative to the handle member to disengage respective weights, wherein each said rotating step rotates a respective said subset of the weight selectors relative to the other said subset of the weight selectors.

8. The method of claim 7, further comprising the step of latching each of the weight selectors in one of the first orientation and the second orientation.

9. The method of claim 7, wherein the handle member is provided with a rod that spans the intermediate portion and each said end portion, and the weights are provided with respective, upwardly opening slots to receive respective portions of the rod, and the moving step involves inserting the respective portions of the rod into the respective, upwardly opening slots.

10. A method of providing adjustable resistance to exercise, comprising the steps of:

providing a first set of weights and a second set of weights;

providing a base sized and configured to support each set of weights at a respective end of the base;

providing a handle member having an intermediate portion that is sized and configured for grasping, a first end portion that is sized and configured to support the first set of weights, and an opposite, second end portion that is sized and configured to support the second set of weights;

providing weight selectors on each said end portion, wherein each of the weight selectors is provided with a leaf spring portion, and is configured and arranged to selectively engage and disengage a respective one of the weights as a function of orientation relative thereto;

moving the handle member to a rest position relative to the weights and the base;

rotating desired weight selectors to a first orientation relative to the handle member to engage respective weights;

rotating desired weight selectors to a second orientation relative to the handle member to disengage respective weights, wherein each said rotating; and latching each of the weight selectors in one of the first orientation and the second orientation by moving the leaf spring portion into a respective notch at a respective end of the handle member.

11. The method of claim 10, wherein each portion is configured as a weight housing having a top wall, and each said leaf spring portion is configured and arranged to extend through a respective slot in the top wall, and each said notch is formed in the top wall at a respective end of a respective slot, and the rotating step involves deflecting the leaf spring portion out of a first notch in a direction perpendicular to the slot to align with the slot, then moving the leaf spring portion along the slot, and then allowing the leaf spring portion to deflect into a second notch at an opposite end of the slot.

12. The method of claim 10, wherein each of the weight selectors is provided with a discontinuous, circumferential lip, and the rotating step involves rotation of the lip into and out of an underlying position relative to a protrusion on a respective one of the weights.

13. A method of providing adjustable resistance to exercise, comprising the steps of:

providing a first set of weights and a second set of weights;

providing a base sized and configured to support each set of weights at a respective end of the base;

providing a handle member having an intermediate portion that defines a longitudinal axis and is sized and configured for grasping, a first weight housing disposed at a first end of the handle member and sized and configured to support the first set of weights, and a second weight housing disposed at an opposite, second end of the handle member and sized and configured to support the second set of weights;

providing multiple weight selectors at longitudinally spaced locations on each said weight housing with first portions that are configured and arranged to protrude through respective, longitudinally spaced slots in a respective weight housing, and second portions that are selectively movable into engagement and disengagement relative to respective weights;

lowering the handle member into a rest position relative to the weights and the base; and moving desired weight selectors relative to the handle member to adjust which weights are connected to the handle member and which weights are disconnected from the handle member.

14. The method of claim 13, wherein each said weight housing is provided with a top wall, and said slots extend across respective first portions between first ends of respective slots and second ends of respective slots.

15. The method of claim 14, wherein each said weight housing is provided with notches at respective ends of respective slots, and the moving step involves deflecting respective first portions out of respective first notches in a direction perpendicular to the slots to align with the slots, then moving the first portions along respective slots, and then allowing the first portions to deflect into respective second notches at opposite ends of respective slots.

16. The method of claim 13, the first portions of the weight selectors are configured and arranged to be maneuvered by hand, and the moving step involves direct handling of the desired weight selectors.

17. The method of claim 13, wherein the moving step involves user contact with each of the desired weight selectors.

18. The method of claim 13, wherein the moving step involves rotating desired weight selectors relative to the handle member.

* * * * *